US005508479A

United States Patent [19]

Schooley

[11] Patent Number: 5,508,479

[45] Date of Patent: Apr. 16, 1996

[54] ELASTOMERIC ROCKER SWITCH ASSEMBLY

[76] Inventor: John L. Schooley, 830 Hardall Ln., Vista, Calif. 92084

[21] Appl. No.: 341,653

[22] Filed: Nov. 17, 1994

[51] Int. Cl.[6] ..... H01H 3/00; H01H 13/00

[52] U.S. Cl. ..... 200/5 R; 200/18; 200/339; 200/557

[58] Field of Search ..... 200/1 B, 1 V, 200/5 R, 5 A, 6 R, 17 R, 18, 302.1–302.3, 315, 316, 339

[56] References Cited

U.S. PATENT DOCUMENTS

| | | | |
|---|---|---|---|
| 3,408,463 | 10/1968 | Wanlass | 200/6 R |
| 3,654,415 | 4/1972 | Hawkins et al. | 200/302.3 |
| 4,105,882 | 8/1978 | Ulbing et al. | 200/1 V X |
| 4,152,563 | 5/1979 | Bongort | 200/1 B X |
| 4,401,864 | 8/1983 | Ichikawa | 200/17 R |
| 4,520,240 | 5/1985 | Swindler | 200/5 R |
| 4,536,625 | 8/1985 | Bebie | 200/339 X |
| 4,760,218 | 7/1988 | Gutman | 200/5 R |

*Primary Examiner*—J. R. Scott

*Attorney, Agent, or Firm*—Ormiston, Korfanta, Dunbar & Holland

[57] ABSTRACT

An elastomeric rocker switch assembly (10) which is particularly suitable for hand held industrial controllers includes an elastomeric switch pad (11) having one or more rocker switch blocks (13) suspended within a sheet (12) by a thin, flexible and resilient web (14). A base plate (25) is provided to support the sheet (12) and to provide a rocker fulcrum point (27) for each rocker switch. An electrical switch supporting member, here printed circuit board (29), is positioned in spaced relationship to the underside of base plate (25), the circuit board having one or more pairs of momentary push button switches (30) thereon, one pair per rocker switch. Switches (30) are positioned to interfere with the underside of the rocker switch when the switch is pivoted about its fulcrum point.

27 Claims, 11 Drawing Sheets

ELASTOMERIC ROCKER SWITCH ASSEMBLY

BACKGROUND OF THE INVENTION

1. Technical Field:

This invention generally relates to electronic rocker switches. In particular, this invention relates to a rugged elastomeric rocker switch assembly particularly suited to hand held controllers such as a hand held radio controller.

2. Background:

Industrial equipment, especially in the construction and locomotive industries, oftentimes requires remote control capability. This is most conveniently accomplished using hand held controllers which are either physically coupled to the controlled unit using an electrical cable or coupled via a radio frequency link using a receiver on the controlled unit and a transmitter in the hand held controller. Incorporating a transmitter in the controlled unit and a receiver in the remote unit allows for remote monitoring of the controlled unit as well as control.

Necessarily, the interface between the user and the hand held transmitter must be rugged to withstand inevitable rough use and inclement weather, but at the same time allow for a high degree of control, be simple to operate and anticipate potential safety hazards.

Prior to the present invention, the interface consisted of a series of toggle switches, a cellular key pad, simple two position slide switches and/or momentary push button switches. Because of the nature of the type of equipment being controlled, different switch actions are necessary. For example, the swing of a crane can be either right or left, making the use of a three position switch desirable, one position for the left direction, one position for the right direction and a neutral position. Similarly, a telescoping boom crane can be extended, retracted or remain set at a particular length. An emergency stop feature is almost always necessary and is most efficiently provided for by a normally open switch which latches closed upon activation and remains closed until manually reset once the hazardous condition has been eliminated.

One of the more common complaints with both toggle switches and momentary push button switches is that they are small and therefor difficult to feel and manipulate, especially when the operator has to wear gloves. Further, both are easily penetrated by dirt and moisture, causing the switch to become inoperable. Attempts to correct this later problem have largely been unsatisfactory. The largest complaint with the cellular key pad interface is that it is all but impossible to feel the action of the individual switches through gloves. Additionally, cellular switches are prone to failure after extended use due to a breakdown of the resilient diaphragm.

What is needed is a rugged switch mechanism which is reliable, simple to operate, water resistant, resistant to penetration by other foreign matter, easily configurable to provide virtually any momentary or latching switch action and which provides both a larger surface area for operator interaction and a pleasant, positive "feel."

DISCLOSURE OF INVENTION

These needs, as well as others, are satisfied by an elastomeric rocker switch assembly which includes: an elastomeric switch pad having one or more rocker switch blocks suspended within a sheet by a thin, flexible and resilient web; a base plate for supporting the sheet and providing a rocker fulcrum point for each rocker switch; and a printed circuit board positioned in spaced relationship to the underside of the base plate, the circuit board having one or more pairs of momentary push button switches thereon, one pair per rocker switch, positioned to interfere with the underside of the rocker switch when the switch is pivoted about its fulcrum point. Advantageously, the sheet, rocker switch blocks and supporting webs are all integrally molded from an elastomeric material such as rubber, rubberized plastic or Teflon®. However, it should be noted that different materials could be employed as long as they demonstrate similar properties.

The elastomeric rocker switch assembly can be incorporated into various electrical devices and is particularly well suited for industrial applications such as a hand held radio remote controller. To accomplish this, a rocker switch assembly having a plurality of individual rocker switches is attached within a compact housing which includes a radio frequency transmitting circuit. The rocker switch assembly is electrically connected to the transmitting circuit. The housing also provides an attachment point for an optional antenna to extend the operating distance of the controller.

While the invention is described herein in the context of a switch for use on hand held remote controllers, it should be noted that it could be suitable for a variety of other electrical applications.

BEST MODE FOR CARRYING OUT INVENTION

Figure 1:
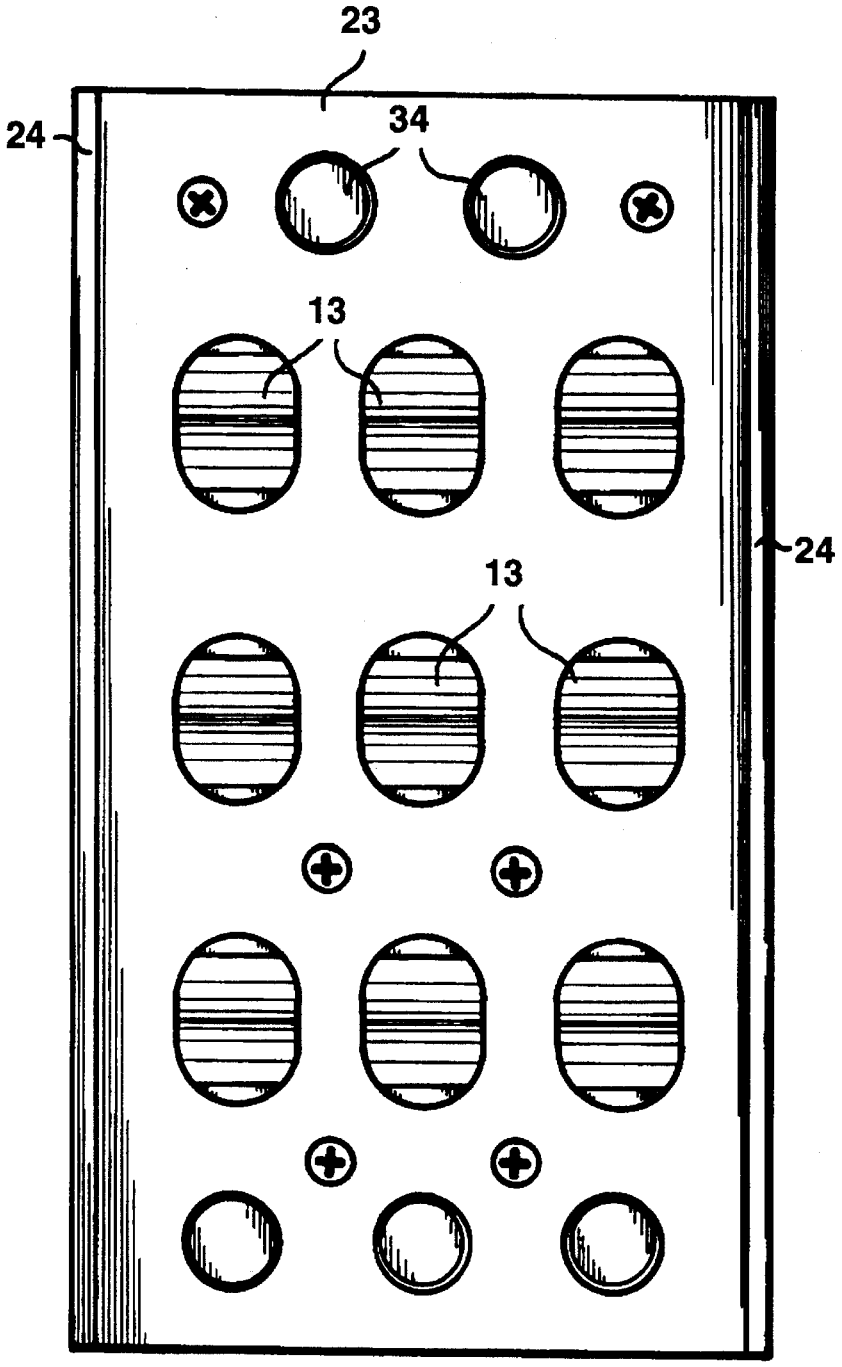
FIG. 1 is a front view of the switch plate and switch pad assembly according to the invention.

Referring now to the figures, the details of an elastomeric rocker switch assembly 10, in combination with a radio frequency transmitting circuit 33, are illustrated.

Elastomeric rocker switch assembly 10 has three basic parts being: switch pad 11; base plate 25; and an electrical switch support, here printed circuit board 29.

Switch pad 11 itself has three components which are integrally attached together, preferably molded as a single piece from an elastomeric material. The first element is a switch pad base member 12, here an elastomeric sheet. Switch pad base member 12 includes one or more rocker switch blocks 13, which are the second element of switch pad 11, suspended by a thin web connector 14, the third element of switch pad 11. Similarly, switch pad 11 can contain button type switch blocks, shown at 34, or a variety of other switch block configurations.

Rocker switch blocks 13 are here generally elongated forms which rock about a lower generally centrally located fulcrum portion, here designated as rocker ridge 20. Rocker ridge 20 protrudes downwardly from the lower surface 17 of base 16. One or more nibs 21 protrude downwardly from each rocker ridge 21, each nib 21 having a retaining ridge or shoulder 22 configured to interfere with nib holes 35 in fulcrum or rocker bars 27 of base 25, as is explained further below. Each rocker switch block 13 further has a pair of switch projections or cusps 18, each of which protrudes downwardly from the lower surface 17 at opposing ends of switch block 13. Preferably, the interior surface of cusps 18 are convexly arcuate in shape so as not to interfere with base plate 25. The lower most portions of cusps 18 are configured to interact with electrical switch 30 as is more thoroughly explained below. The upper surface 15 of each switch block 13 can be configured in as number of ways. In this preferred embodiment, upper surface 15 is concavely arcuate in shape along the longitudinal axis of switch block 13 to comfortably conform to the convex shape of a human thumb or finger.

Each switch block 13 is suspended within base member 12 by a thin elastomeric web connector 14. Web connector 14 is connected at its interior edge to and around, or around and slightly above, the perimeter of the base 16 of each switch block 13. Likewise, web 14 is connected at its exterior edge to the perimeter of an opening in elastomeric base member 12, the opening generally conforming to the shape of the perimeter of switch block 13. Preferably, elastomeric base member 12, webs 14 and switch blocks 13 are all molded as a single piece unit. However, it should be noted that it is possible to construct switch pad 11 using distinctly different materials, the primary limitation being on webs 14 which at least must be made of a flexible material to allow switch blocks 13 to move with respect to base member 12.

Figure 2:
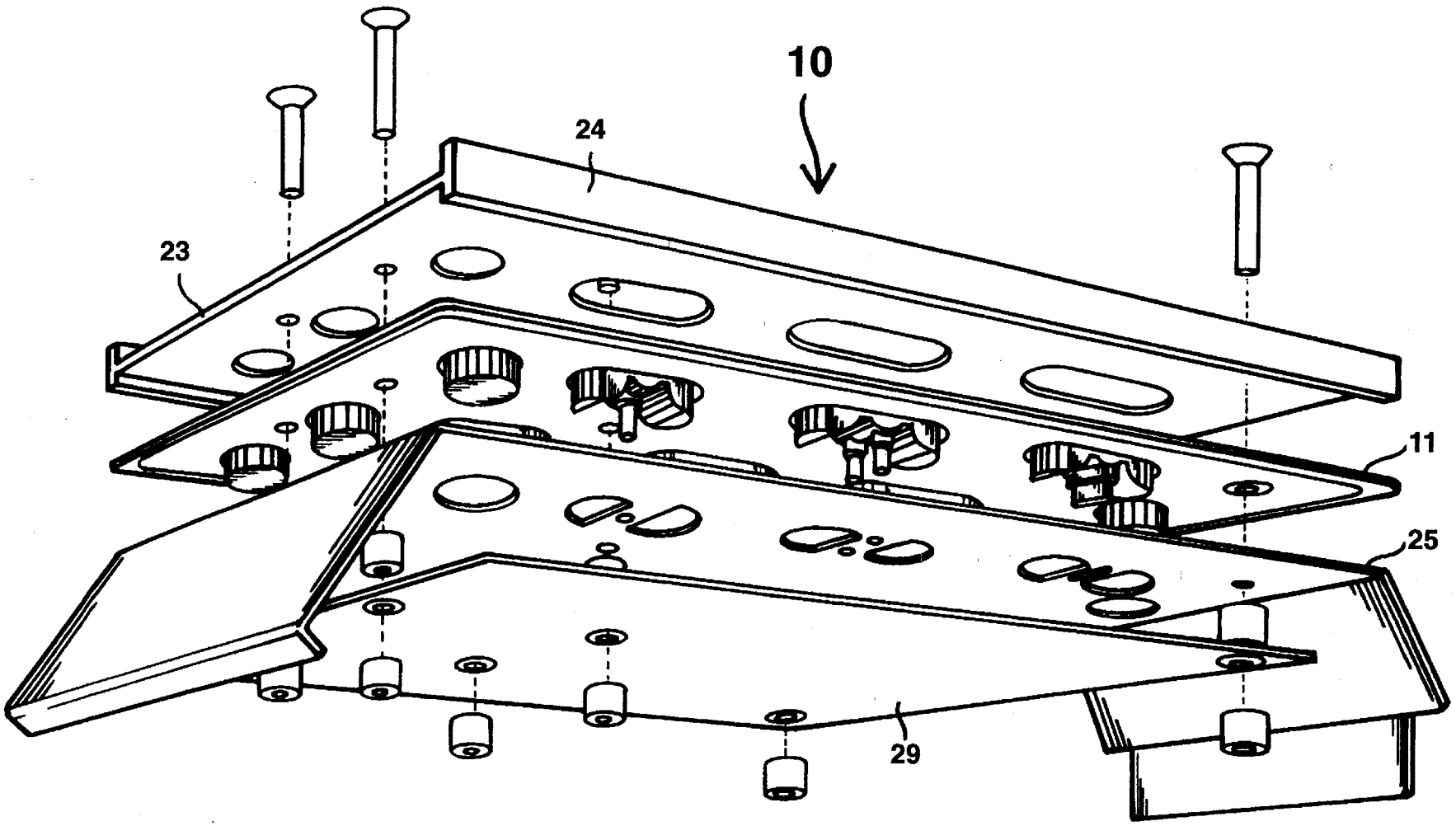
FIG. 2 is an exploded bottom perspective view of the elastomeric rocker switch assembly.
Figure 4:
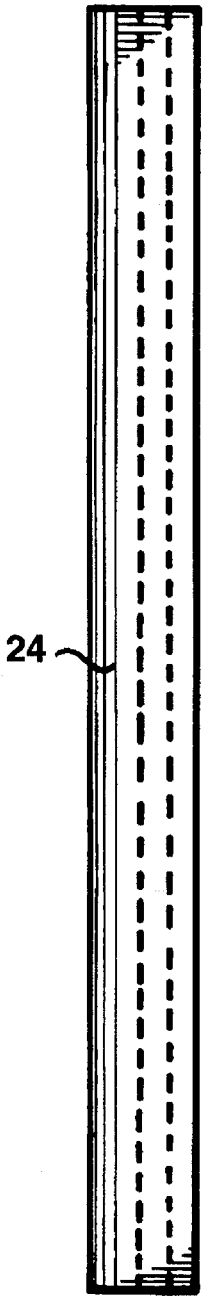
FIG. 4 is a side view of the switch plate.
Figure 3:
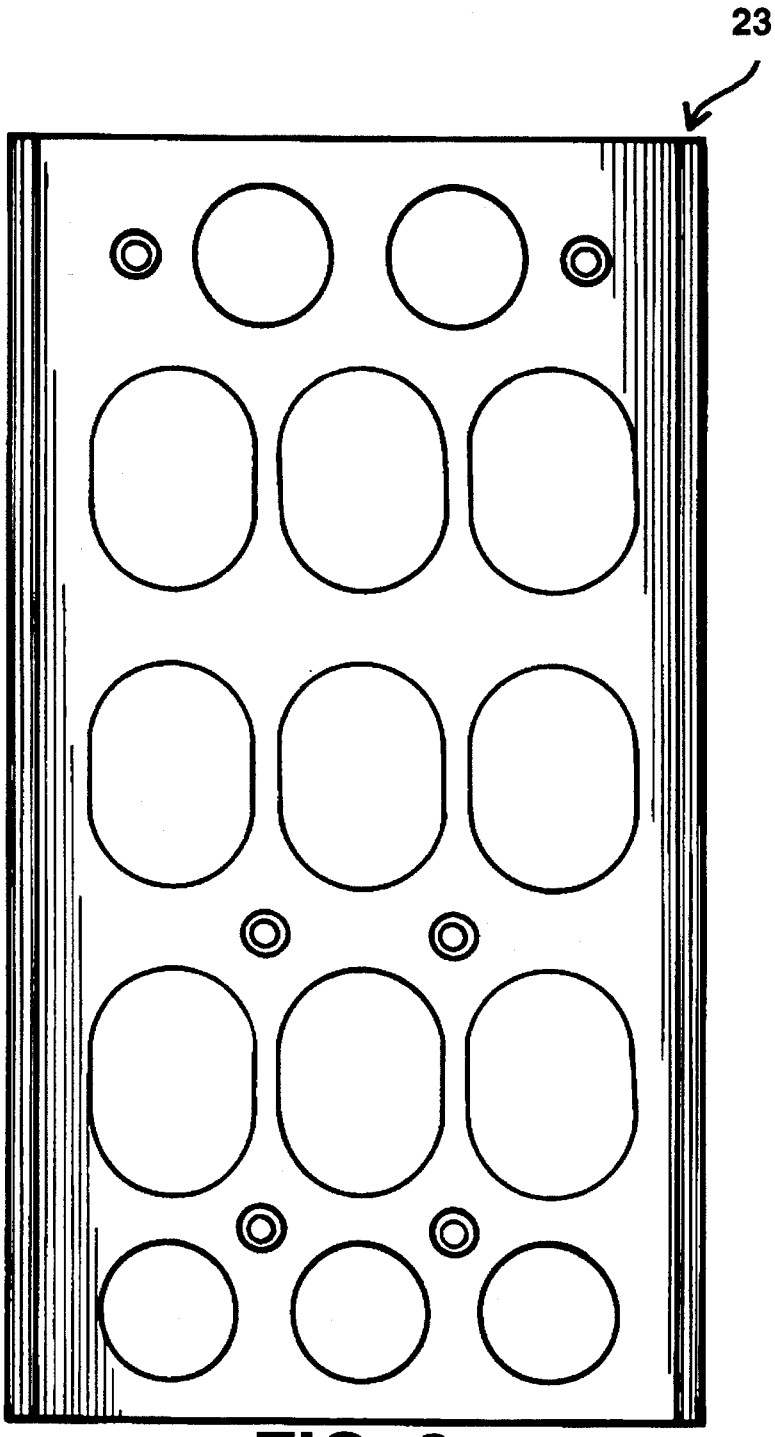
FIG. 3 is a front view of the switch plate.
Figure 5:
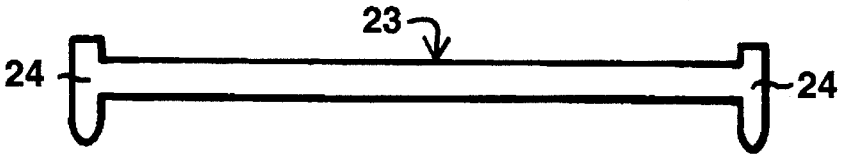
FIG. 5 is an end view of the switch plate.
Figure 6:
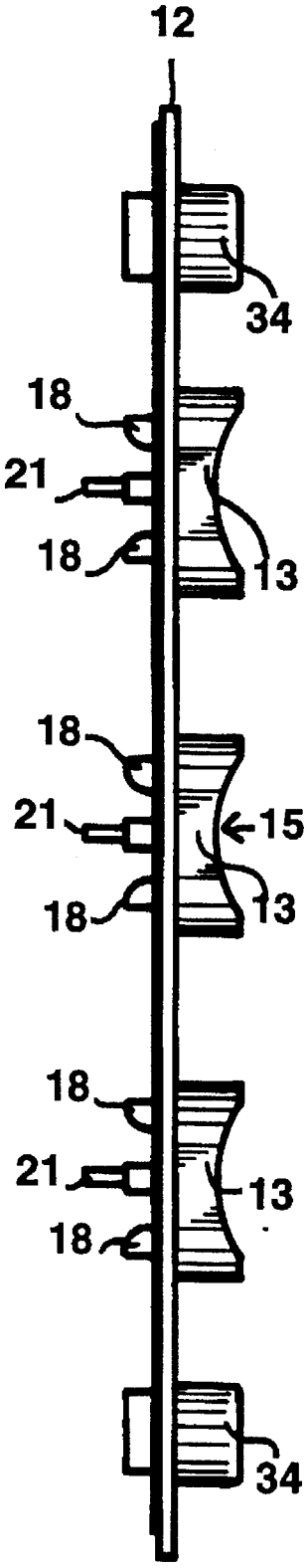
FIG. 6 is a side view of the switch pad.
Figure 7:
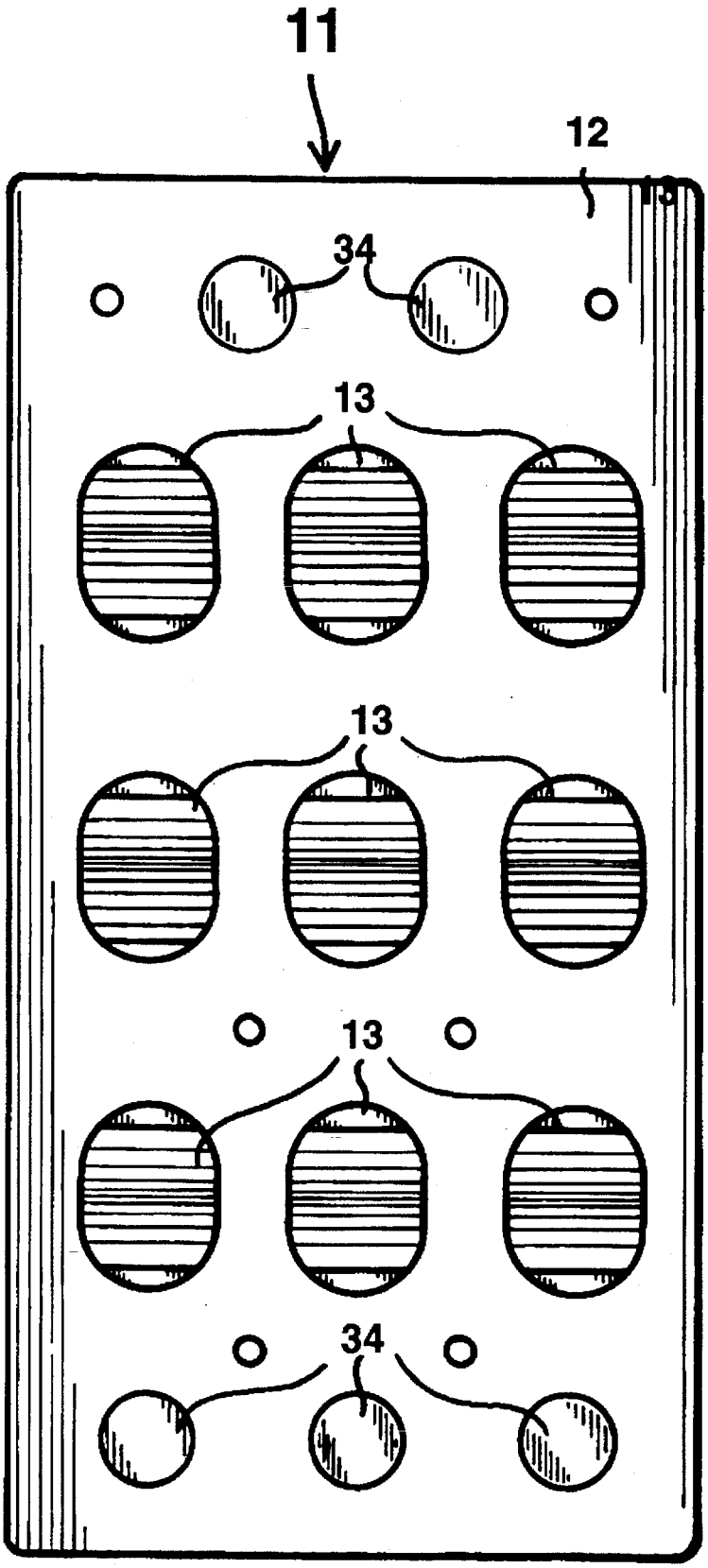
FIG. 7 is a front view of the switch pad.
Figure 8:
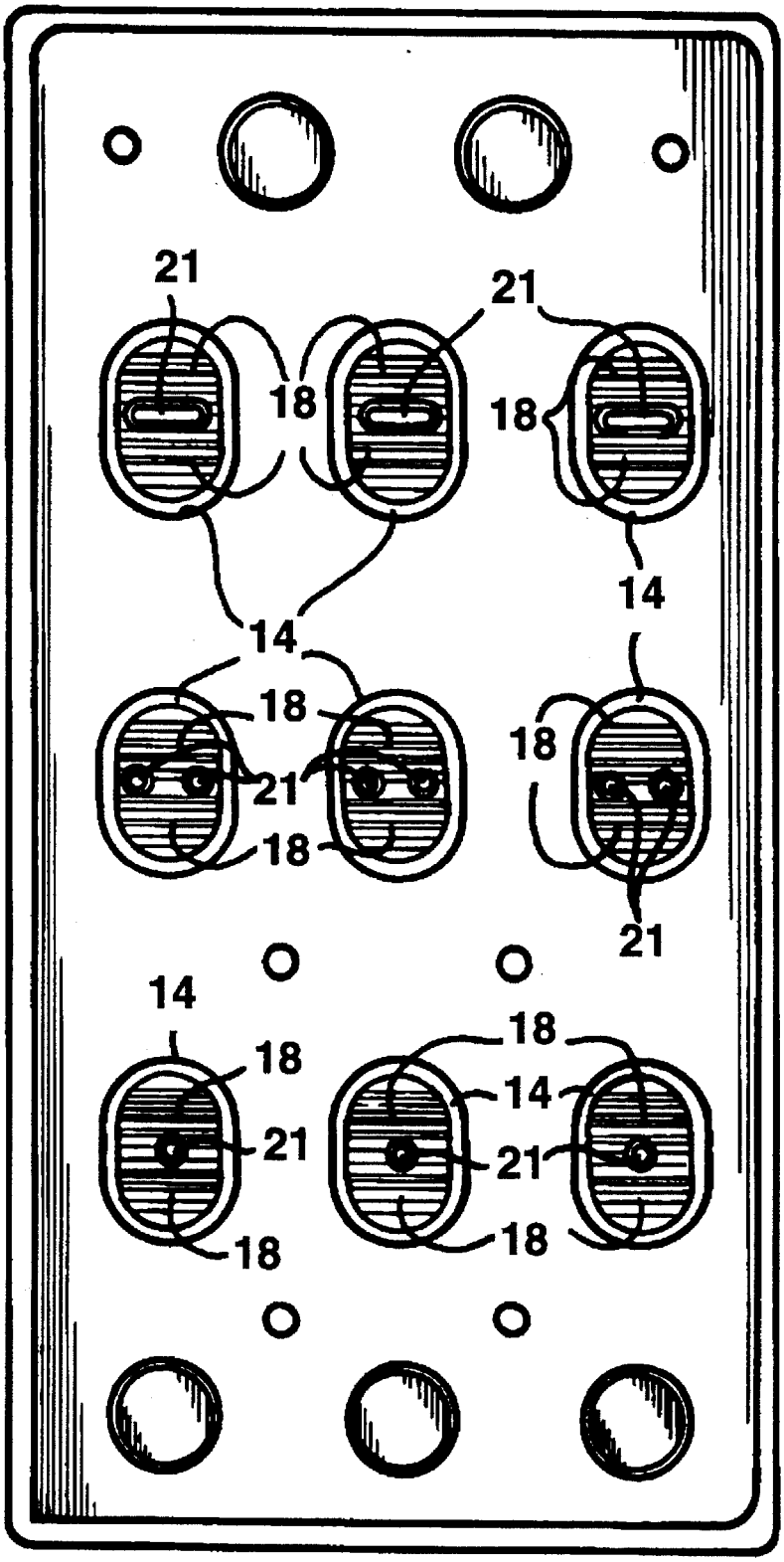
FIG. 8 is back view of the switch pad.
Figure 9:
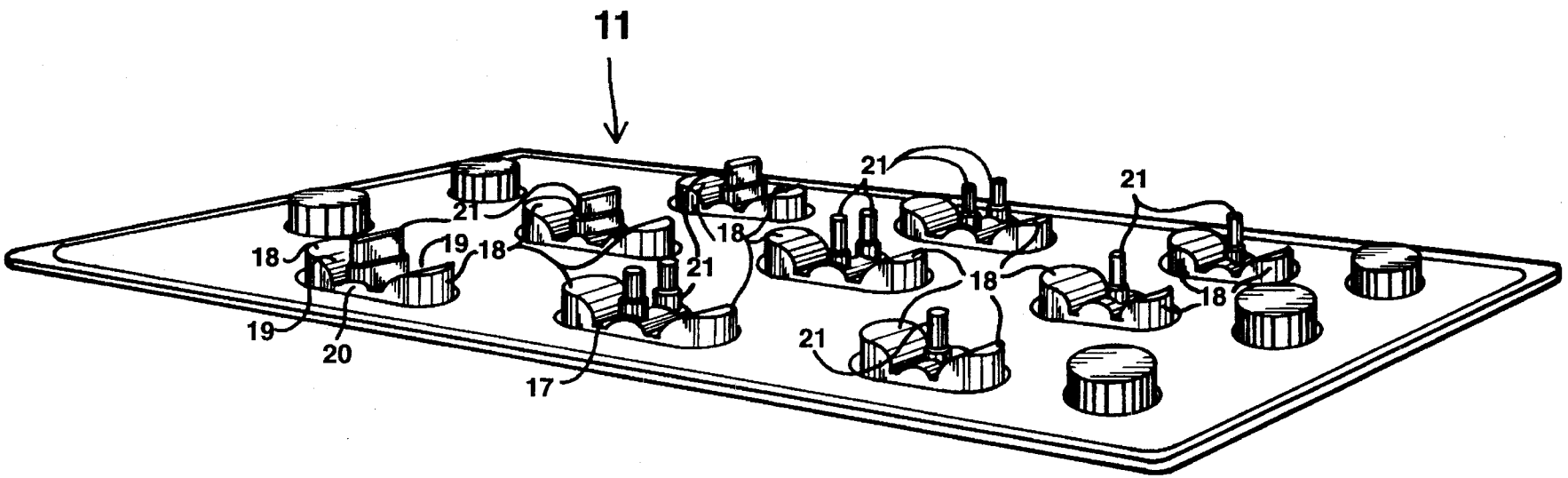
FIG. 9 is a perspective view of the back of the switch pad.
Figure 10:
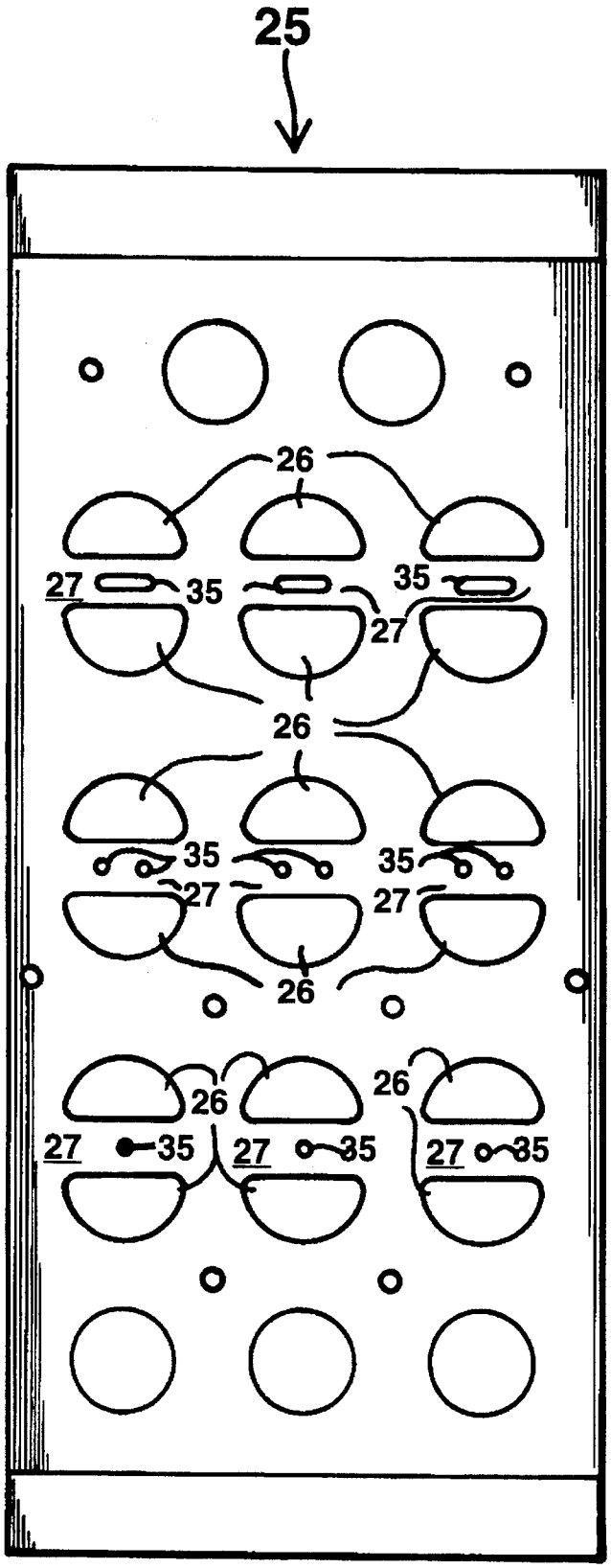
FIG. 10 is a front view of the base plate.
Figure 11:
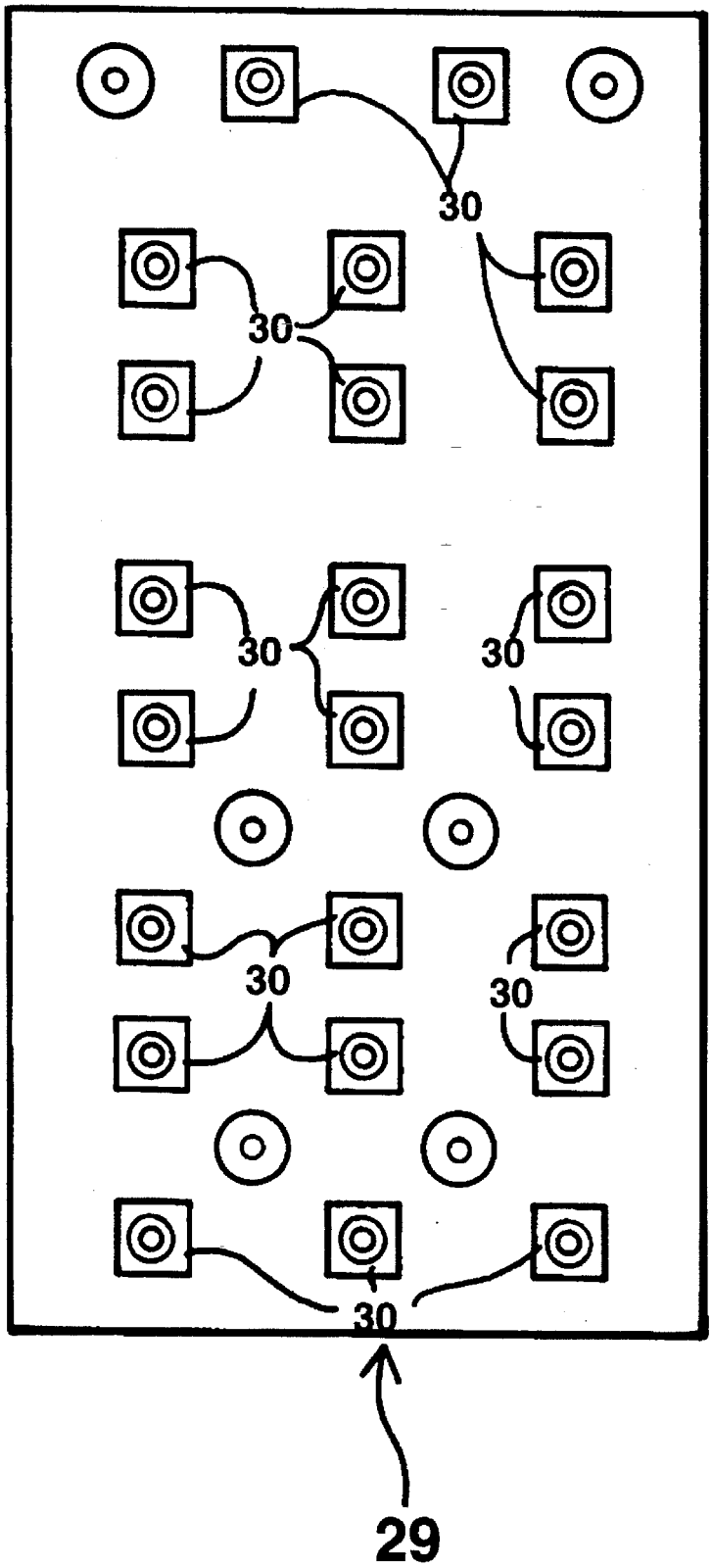
FIG. 11 is a front view of the printed circuit board.
Figure 12:
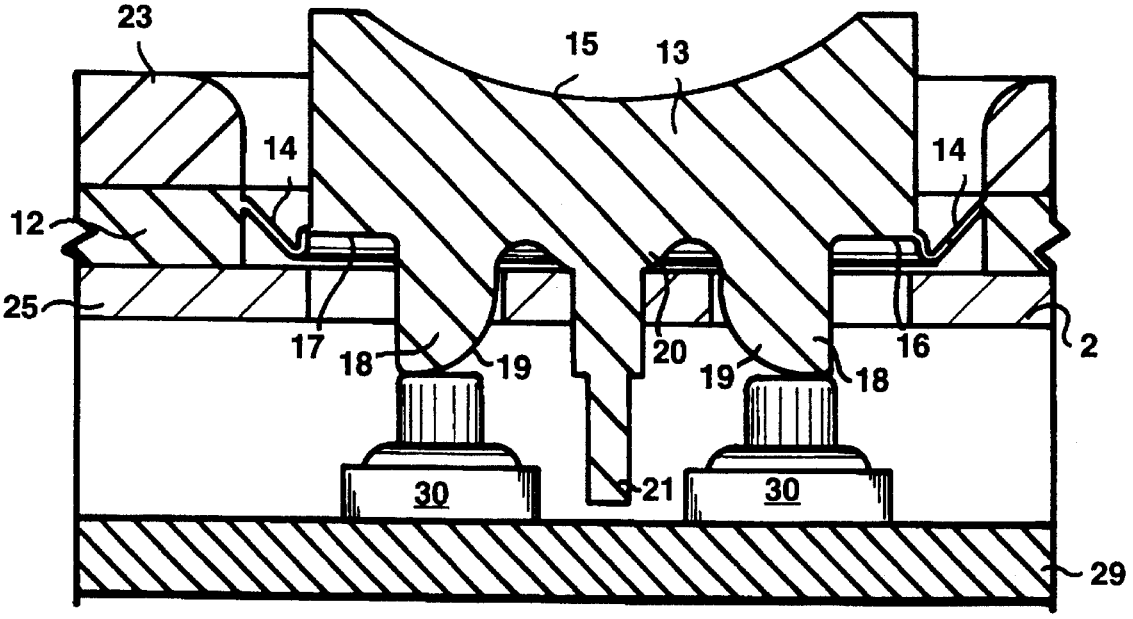
FIG. 12 is a side cross section view of an elastomeric rocker switch assembly in the neutral position.
Figure 13:
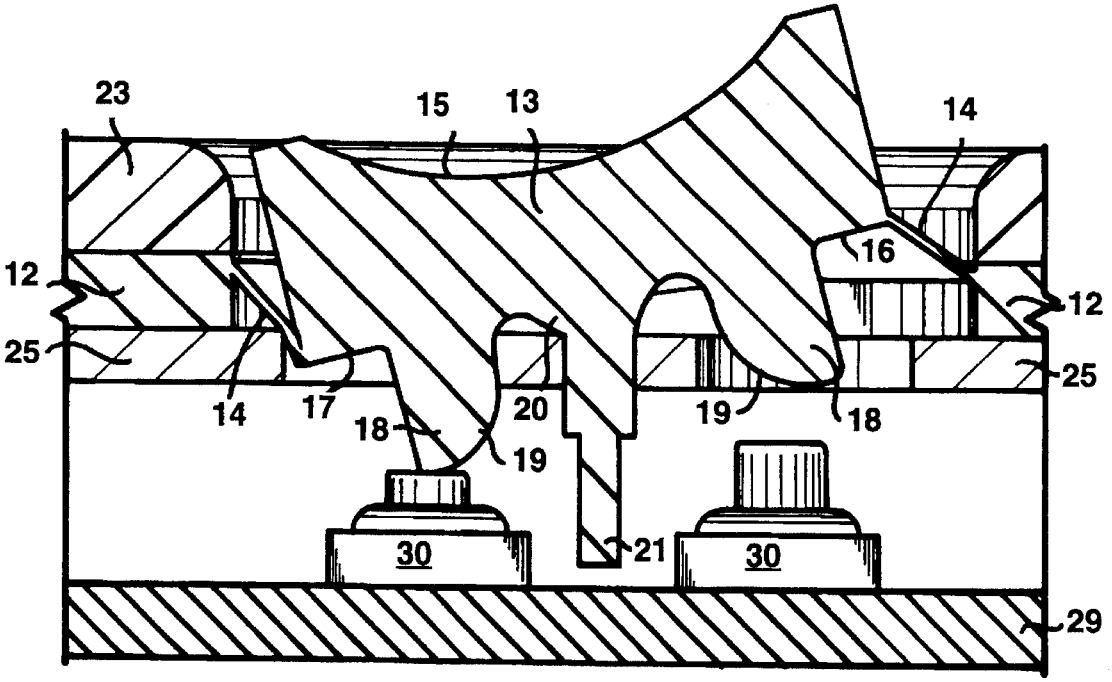
FIG. 13 is a side cross section view of the elastomeric rocker switch assembly of FIG. 12, having one of the two push button electrical switches activated.

Base plate 25 provides a rigid support for switch pad 11. In the preferred embodiment, base plate 25 is constructed from a sheet of aluminum into which a plurality of switch holes 26 are punched or otherwise cut. It should be apparent that other rigid materials are suitable for forming base plate 25, both metallic and nonmetallic compositions. Switch holes 26 are positioned to receive cusps 18 therethrough without interference. Here, a pair of switch holes 26 are cut on either side of a fulcrum or rocker bar 27, the switch holes actually defining the rocker bar. One or more nib holes 35 are formed within each rocker bar 27 to receive and hold nibs 21. Preferably, nibs 21 are formed of an elastomeric material, or at least an elastic deformable material, such that the nib 21 and nib shoulder 22 can be deformed and pulled through nib holes 35 and held there upon return of the nibs and nib shoulders to their original shapes. FIGS. 2, 9 and 10 illustrate three distinct possible configurations for nibs 21 and nib holes 35.

An electrical switch support, here printed circuit board 29, is suspended in spaced relationship to the cusps 18 of switch pad 11 by attaching printed circuit board 29 to the back side of base plate 25 using pylons or standoffs 28. Pairs of push button electrical switches 30 are physically and electrically attached to printed circuit board 29 and positioned such that when a switch block 13 is pivoted about its respective fulcrum bar 27 in a first radial direction, the first electrical switch engagement surface of one of the cusps 18 will engage and activate a first electrical switch 30 and when the same switch block 13 is pivoted about the fulcrum bar in an opposite direction, the second electrical switch engagement surface on the other cusp 18 will engage and activate the second electrical switch 30.

Electrical switches 30 are, in this preferred embodiment, normally open momentary push button switches which remain activated only as long as the switch is held in an open position. Because of the elastomeric configuration of switch blocks 13 it is physically possible to simultaneously activate both push button switches of a given pair. Since this may not be a desirable result, it is possible, using supporting logic circuitry on printed circuit board 29, to prevent this. Additionally, virtually any switch configuration can be mimicked using momentary push button switch and supporting circuitry. For example, a flip-flop could be used to produce a latching type switch which would be activated by one or more depressions of one side of the rocker switch and deactivated by a single depression of the other side of the switch. Debouncing circuitry can be easily implemented, as can various other configurations. Printed circuit board 29 can also be used to support other circuitry such as a radio frequency transmitting circuit 33. A connector can also be provided on printed circuit board 29 to electrically connect rocker switch assembly 10 to other circuitry, including radio frequency transmitting circuitry.

A switch plate 23 can be provided to both protect and secure switch pad 11. Here, switch plate 23 has a pair of protective rails 24 extending upward from the side marginal edges of the switch plate. The height of the rails is preferred to be greater than or equal the height of switch blocks 13. This feature helps prevent accidental activation of any of the switches. Switch plate 23 includes a plurality of openings through which the top surfaces of the various switch blocks protrude. Switch plate 23 can be manufactured from any durable material desired, preferably a resilient plastic and possibly an anti-corrosive material. Advantageously, the same screws which hold switch plate 23 over switch pad 11 and secure it to base plate 25, also suspend printed circuit board 29 from base plate 25.

Figure 14:
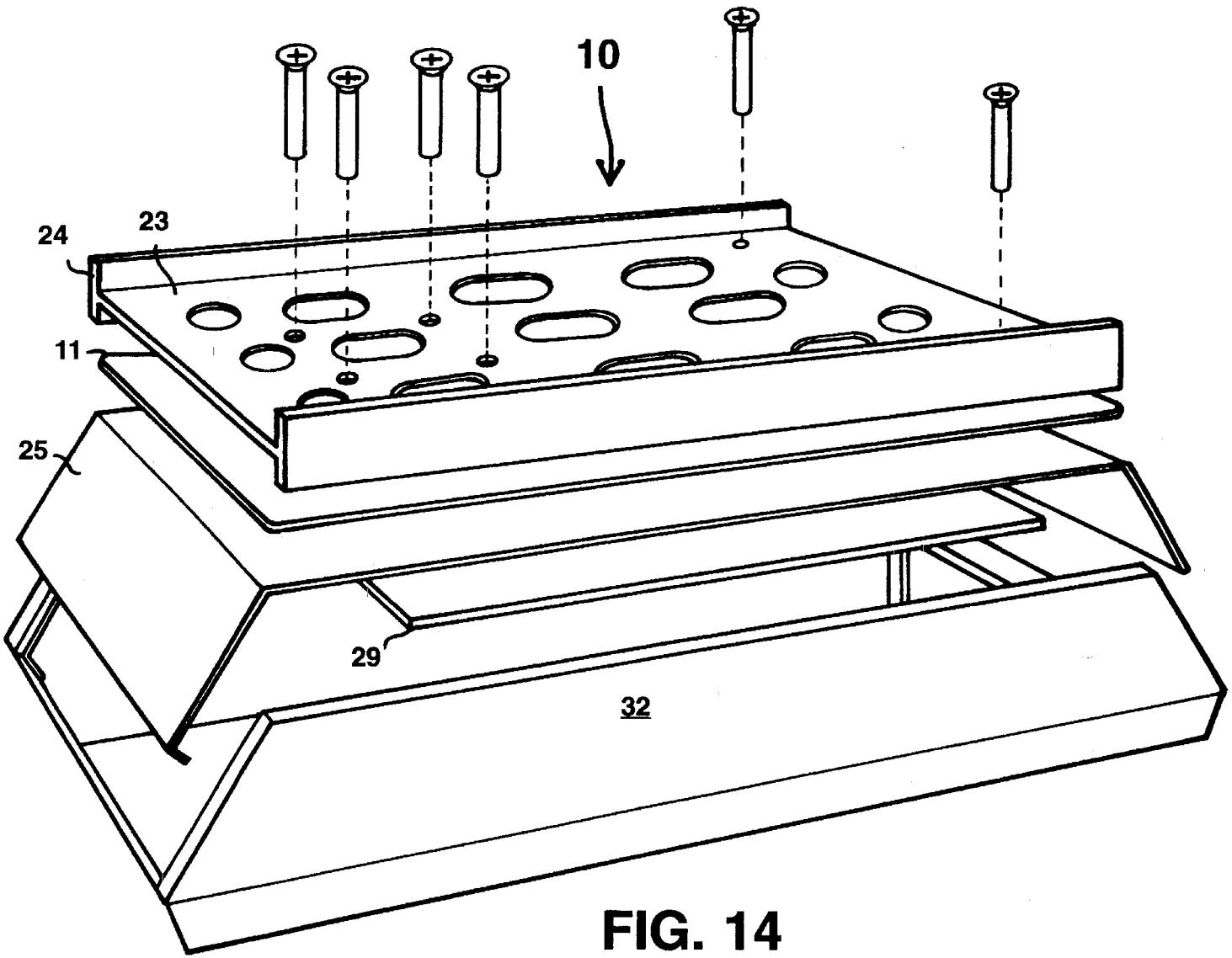
FIG. 14 is an exploded perspective view of the hand held radio controller assembly according to the invention.
Figure 15:
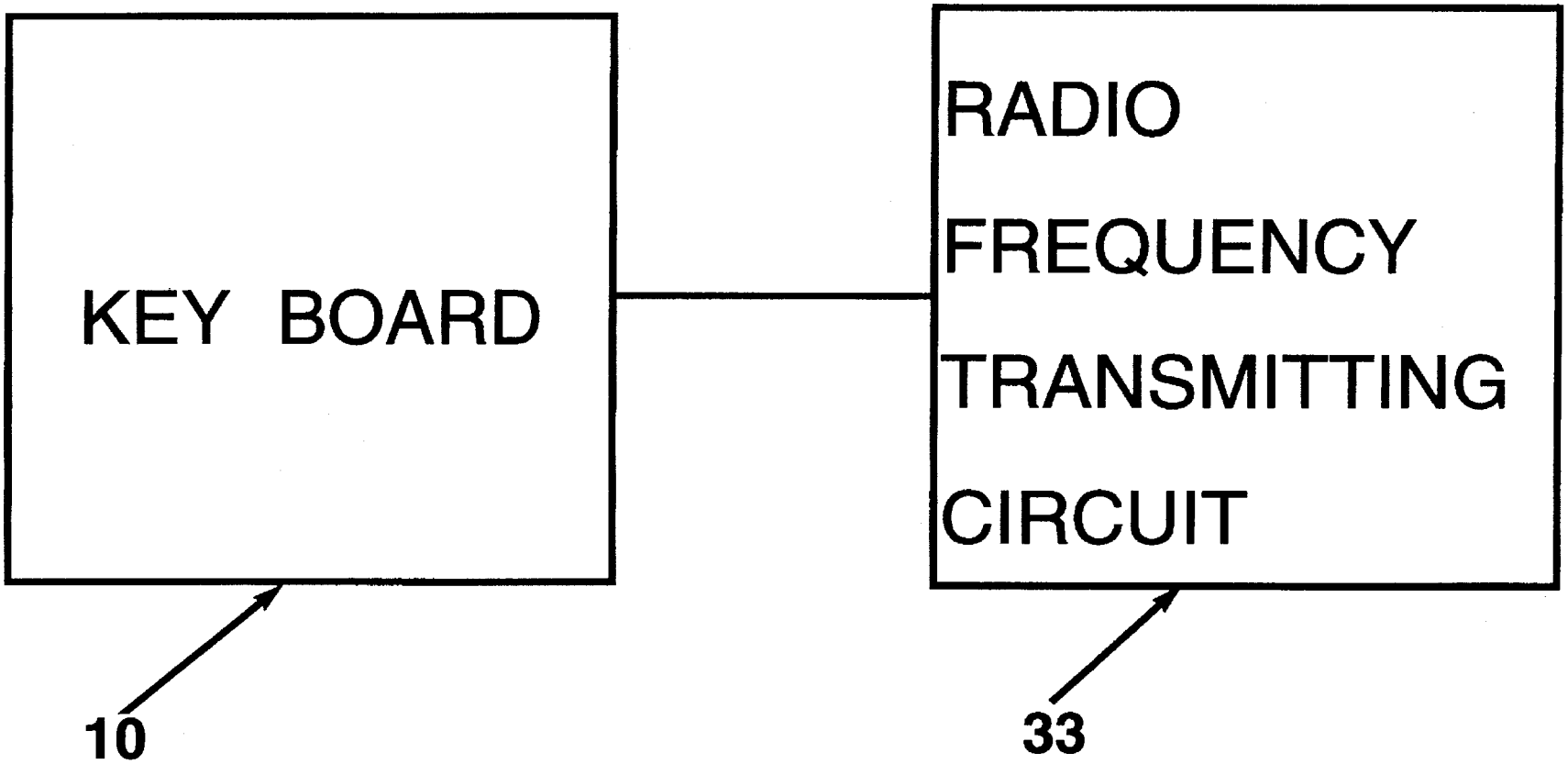
FIG. 15 is a simplified circuit block diagram of the hand held radio frequency transmitter according to the invention.

One particularly useful application of elastomeric rocker switch assembly 10 is in a radio frequency hand held remote controller such as that designated as 31 in FIG. 14. Here, rocker switch assembly 10 is secured within a suitable housing 32. Housing 32 also serves as a convenient attachment point for an antenna which extends the operating range for radio frequency transmitting circuit 33, for example.

While there is shown and described the present preferred embodiment of the invention, it is to be distinctly understood that this invention is not limited thereto but may be variously embodied to practice within the scope of the following claims.

I claim:

1. A rocker switch assembly comprising:

an elastomeric base member having formed therein a thin elastomeric web encircling and joined to a switch block, the switch block having upper and lower surfaces where the lower surface includes a fulcrum portion and first and second electrical switch engagement surfaces, the fulcrum portion including an elastic nib depending therefrom and the nib including fulcrum bar engagement means;

a base plate including a fulcrum bar configured to pivotally engage the fulcrum portion of the switch block and to fixedly engage the fulcrum bar engagement means of the nib; and first and second electrical switches being held in spaced relationship to the first and second electrical switch engagement surfaces and positioned such that when the switch block is pivoted about the fulcrum bar in a first radial direction the first electrical switch engagement surface will engage and activate the first electrical switch and when the switch block is pivoted about the fulcrum bar in an opposite direction, the second electrical switch engagement surface will engage and activate the second electrical switch.

2. The rocker switch assembly of claim 1 wherein the switch block is elongated along a longitudinal axis parallel to the upper surface.

3. The rocker switch assembly of claim 2 wherein the upper surface is concave with respect to the longitudinal axis.

4. The rocker switch assembly of claim 3 wherein the switch block includes a pair of projections extending from the lower surface terminating at points below the fulcrum portion.

5. The rocker switch assembly of claim 2 wherein the switch block includes a pair of projections extending from the lower surface terminating at points below the fulcrum portion.

6. The rocker switch assembly of claim 1 wherein the switch block includes a pair of projections extending from the lower surface terminating at points below the fulcrum portion.

7. The rocker switch assembly of claim 6 wherein each projection has a convex arcuate interior surface configured to prevent interference of the projections with the fulcrum bar and wherein the fulcrum portion of the switch block has a convex arcuate surface to facilitate pivoting of the switch block about the fulcrum bar.

8. The rocker switch assembly of claim 5 wherein each projection has a convex arcuate interior surface configured to prevent interference of the projections with the fulcrum bar and wherein the fulcrum portion of the switch block has a convex arcuate surface to facilitate pivoting of the switch block about the fulcrum bar.

9. The rocker switch assembly of claim 4 wherein each projection has a convex arcuate interior surface configured to prevent interference of the projections with the fulcrum bar and wherein the fulcrum portion of the switch block has a convex arcuate surface to facilitate pivoting of the switch block about the fulcrum bar.

10. The rocker switch assembly of claim 9 further comprising a printed circuit board being attached in spaced relationship to the base plate, the electrical switches being physically and electrically attached to the printed circuit board.

11. The rocker switch assembly of claim 8 further comprising a printed circuit board being attached in spaced relationship to the base plate, the electrical switches being physically and electrically attached to the printed circuit board.

12. The rocker switch assembly of claim 7 further comprising a printed circuit board being attached in spaced relationship to the base plate, the electrical switches being physically and electrically attached to the printed circuit board.

13. The rocker switch assembly of claim 6 further comprising a printed circuit board being attached in spaced relationship to the base plate, the electrical switches being physically and electrically attached to the printed circuit board.

14. The rocker switch assembly of claim 5 further comprising a printed circuit board being attached in spaced relationship to the base plate, the electrical switches being physically and electrically attached to the printed circuit board.

15. The rocker switch assembly of claim 4 further comprising a printed circuit board being attached in spaced relationship to the base plate, the electrical switches being physically and electrically attached to the printed circuit board.

16. The rocker switch assembly of claim 3 further comprising a printed circuit board being attached in spaced relationship to the base plate, the electrical switches being physically and electrically attached to the printed circuit board.

17. The rocker switch assembly of claim 2 further comprising a printed circuit board being attached in spaced relationship to the base plate, the electrical switches being physically and electrically attached to the printed circuit board.

18. The rocker switch assembly of claim 1 further comprising a printed circuit board being attached in spaced relationship to the base plate, the electrical switches being physically and electrically attached to the printed circuit board.

19. A hand held remote controller comprising:

a housing;

a radio frequency electronic transmitting circuit being housed within the housing;

an elastomeric base member having formed therein a plurality of thin elastomeric webs, each web encircling and joined to a switch block, each switch block having upper and lower surfaces where the lower surface includes a fulcrum portion and first and second electrical switch engagement surfaces, the fulcrum portion including an elastic nib depending therefrom and the nib including fulcrum bar engagement means;

a base plate including a plurality of fulcrum bars, each being configured to pivotally engage the fulcrum portion of one of the switch blocks and to fixedly engage the fulcrum bar engagement means of the nib, the base plate being attached within the housing;

a plurality of pairs of first and second electrical switches being held in spaced relationship and proximate to the first and second electrical switch engagement surfaces and positioned such that when a switch block is pivoted about the fulcrum bar in a first radial direction the first electrical switch engagement surface will engage and activate a first electrical switch of a pair of switches and when the switch block is pivoted about the fulcrum bar in an opposite direction, the second electrical switch engagement surface will engage and activate the second electrical switch of the pair of switches; and a printed circuit board being attached in spaced relationship to the base plate, the electrical switches being physically and electrically attached to the printed circuit board and electrically connected to the transmitting circuit.

20. The rocker switch assembly of claim 19 wherein the switch blocks are elongated along a longitudinal axis parallel to the upper surface.

21. The rocker switch assembly of claim 20 wherein the upper surfaces are concave with respect to the longitudinal axis.

22. The rocker switch assembly of claim 21 wherein the switch blocks further include a pair of projections extending from their lower surfaces terminating at points below their fulcrum portion.

23. The rocker switch assembly of claim 20 wherein the switch blocks further include a pair of projections extending from their lower surfaces terminating at points below their fulcrum portion.

24. The rocker switch assembly of claim 19 wherein the switch blocks further include a pair of projections extending from their lower surface terminating at points below their fulcrum portion.

25. The rocker switch assembly of claim 24 wherein each projection has a convex arcuate interior surface configured to prevent interference of the projections with a fulcrum bar and wherein the fulcrum portion of each switch block has a convex arcuate surface to facilitate pivoting of the switch blocks about the fulcrum bars.

26. The rocker switch assembly of claim 23 wherein each projection has a convex arcuate interior surface configured to prevent interference of the projections with a fulcrum bar and wherein the fulcrum portion of each switch block has a convex arcuate surface to facilitate pivoting of the switch blocks about the fulcrum bars.

27. The rocker switch assembly of claim 22 wherein each projection has a convex arcuate interior surface configured to prevent interference of the projections with a fulcrum bar and wherein the fulcrum portion of each switch block has a convex arcuate surface to facilitate pivoting of the switch blocks about the fulcrum bars.

* * * * *